United States Patent [19]

Williams

[11] 4,072,119

[45] Feb. 7, 1978

[54] VERTICAL RISING BOAT LIFT

[76] Inventor: Barney V. Williams, 418 "C" SW. St., Miami, Okla. 74354

[21] Appl. No.: 781,769

[22] Filed: Mar. 21, 1977

[51] Int. Cl.[2] ..... B63C 1/02

[52] U.S. Cl. ..... 114/45; 61/65

[58] Field of Search ..... 114/44, 49, 45, 48; 61/64, 65, 66; 214/1 A

[56] References Cited

U.S. PATENT DOCUMENTS

| | | | |
|---|---|---|---|
| 3,951,087 | 4/1976 | Carson | 114/45 |
| 3,991,695 | 11/1976 | McDonald | 61/65 |

FOREIGN PATENT DOCUMENTS

| | | | |
|---|---|---|---|
| 1,287,521 | 1/1969 | Germany | 114/44 |

*Primary Examiner*—Trygve M. Blix
*Assistant Examiner*—Edward M. Wacyra
*Attorney, Agent, or Firm*—Head, Johnson & Chafin

[57] ABSTRACT

A boat lift for lifting and storing boats out of the water, the lift being arranged for mounting in a boat well having opposed parallel vertical sidewalls spaced above the surface of a body of water, the lift including two pairs of trunnion members affixed to the boat well sidewalls, one pair being in a forward horizontal axial alignment and the other pair in a rearward horizontal axial alignment, the axii being parallel to each other, a frame adapted to be lowered into the water to receive a boat floating in the water thereon and to be raised with the boat on the frame to lift it clear of the water for storage, the frame having a forward pair of guide members and a rearward pair of guide members, each pair of guide members being parallel to each other and each guide member having an elongated slot therein which slidably receives one of the trunnion members, the slot in each of the four guide members being of the same angular relationship to the vertical of between 15° and 75° and preferably about 45°, a pontoon secured to the lower portion of the frame, an opening for admitting water into the pontoon to sink it and a compressor for displacing the water with air to float the pontoon and frame for lifting a boat above the water, the slotted guide members moving on the trunnions to maintain the frame and the boat thereon horizontal as the boat is raised by the pontoon.

7 Claims, 5 Drawing Figures

VERTICAL RISING BOAT LIFT

BACKGROUND AND OBJECTS OF THE INVENTION

Boating is one of the most popular hobbies in the United States and other countries around the world. Some people keep their boats on trailers and take them to the lake or ocean when they want to use them and take them out when they are finished. However, many people store their boats by leaving them in the water. This eliminates the necessity of loading and unloading the boats and makes them readily available.

One problem, however, with leaving a boat floating in the water is that marine growth builds up on the boat hull. In addition, the motors, propellers and any metal portions which extend in the water are rapidly attacked by chemical elements in the water, as well as electrolysis, and deteriorate much more rapidly than if exposed to air rather than water. A further problem is that any small leakage which would not be detrimental when the boat is in use can, if the boat is stored in a long period of time in the water, result in substantial damage to the boat. For all of these reasons and others, it is highly desirable to store boats out of the water.

In order to provide a means of storing a boat out of the water but make it easily launched into the water when needed, pontoon type boat lifts have been devised. As an example, see U.S. Pat. No. 3,727,415, entitled "BOAT DRY DOCKING DEVICE," issued Apr. 17, 1973. This prior issued patent, like others, is pivoted to the front of a boat dock. This means that the rearward portion of the boat lift must sink fairly deep into the water so as to reduce the height of the forward portion of the lift sufficiently to allow the front of a boat clearace as it moves over the submerged boat lift. In addition, as the boat lift is raised with the boat thereon, it pivots the boat which results in the boat being lifted in an arc about the frame pivot axis.

The present invention is directed towards an improved boat lift for mounting in a boat well which has all the advantages of existing types of boat lifts in that it provides an easy means of lifting a boat in and out of the water in a boat well, but at the same time overcomes the disadvantages and limitations of the existed pivoted type of boat lift.

An object of this invention is to provide an improved boat lift for mounting in a boat well. More particularly, an object of this invention is to provide an improved boat lift for mounting in a boat well arranged such that as the lift is moved up and down the frame on which the boat is supported is not pivoted but at all times stays level.

These general objects, as well as other and more specific objects of the invention, will be fulfilled in the following description and claims, taken in conjunction with the attached drawings.

SUMMARY OF THE INVENTION

A vertical rising boat lift for mounting in a well of a boat dock, the well having parallel sidewalls spaced above the surface of a body of water, the boat lift having a frame which is adapted to be lowered below the surface of the water to allow a boat floating in the water to be positioned above the frame and to be raised so as to lift the boat thereon above the surface of the water for storage, the frame having a forward and a rearward pair of guide members, each pair being parallel to each other and each having a guide slot therein at a uniform angle of between 15° and 75° relative to the vertical and preferably about 45° relative to the vertical, a forward pair and rearward pair of trunnion members supported to the boat well sidewalls, each pair being in horizontal axial alignment and the axii of the pairs being parallel to each other, each slot in the frame guide member receiving one of the trunnion members whereby the frame is guided by the trunnion members as it moves up and down, a pontoon secured to the lower portion of the frame, means for admitting water into the pontoon to sink the frame to receive a boat thereon or to discharge a boat into the water and means to evacuate the water from the pontoon to cause it to float and move the frame upwardly for lifting a boat thereon for storage above the water surface.

DESCRIPTION OF THE VIEWS

DETAILED DESCRIPTION

Figure 1:
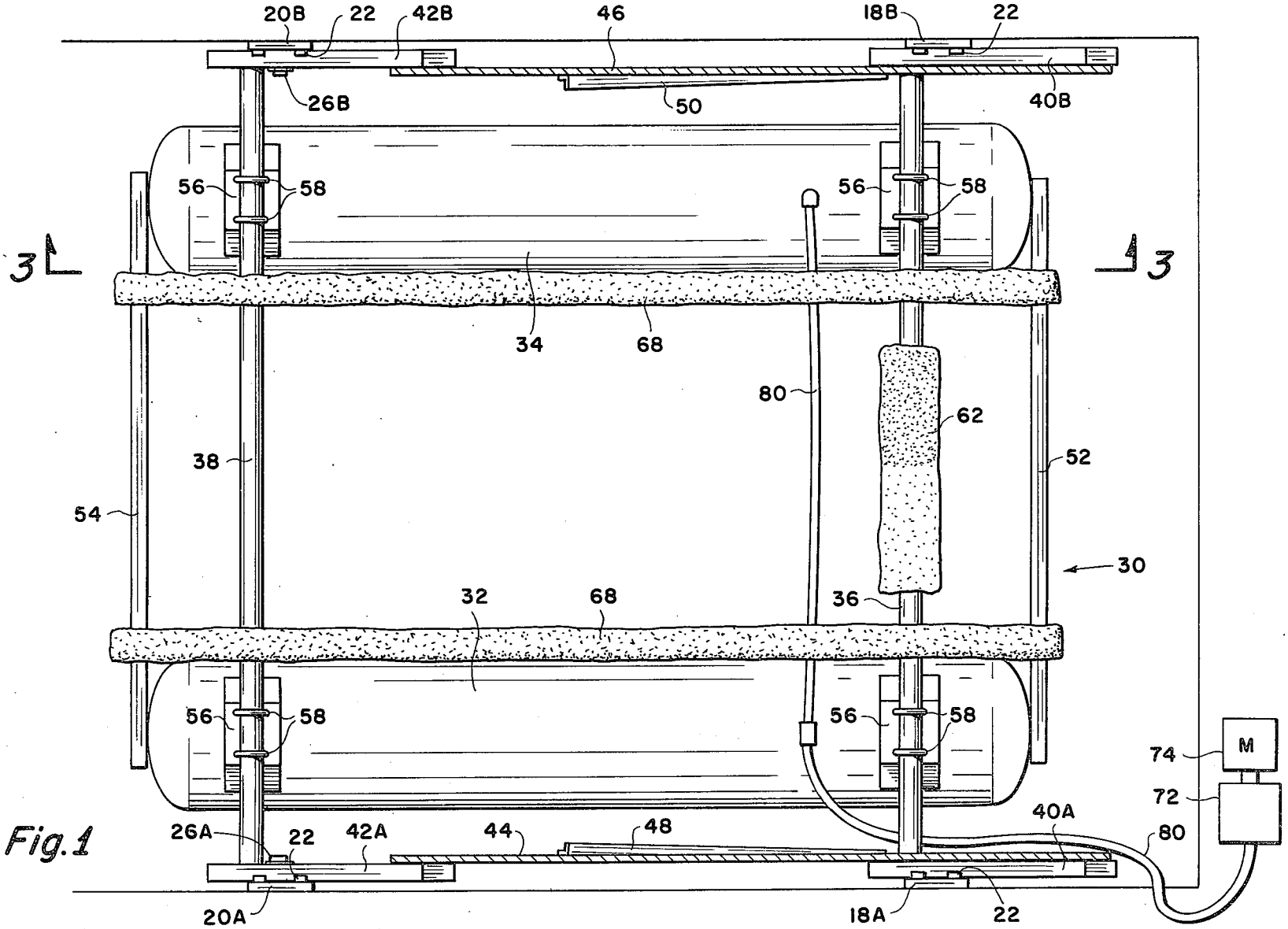
FIG. 1 is a top view of a boat lift embodying the principles of this invention shown mounted in a well in a boat dock.
Figure 2:
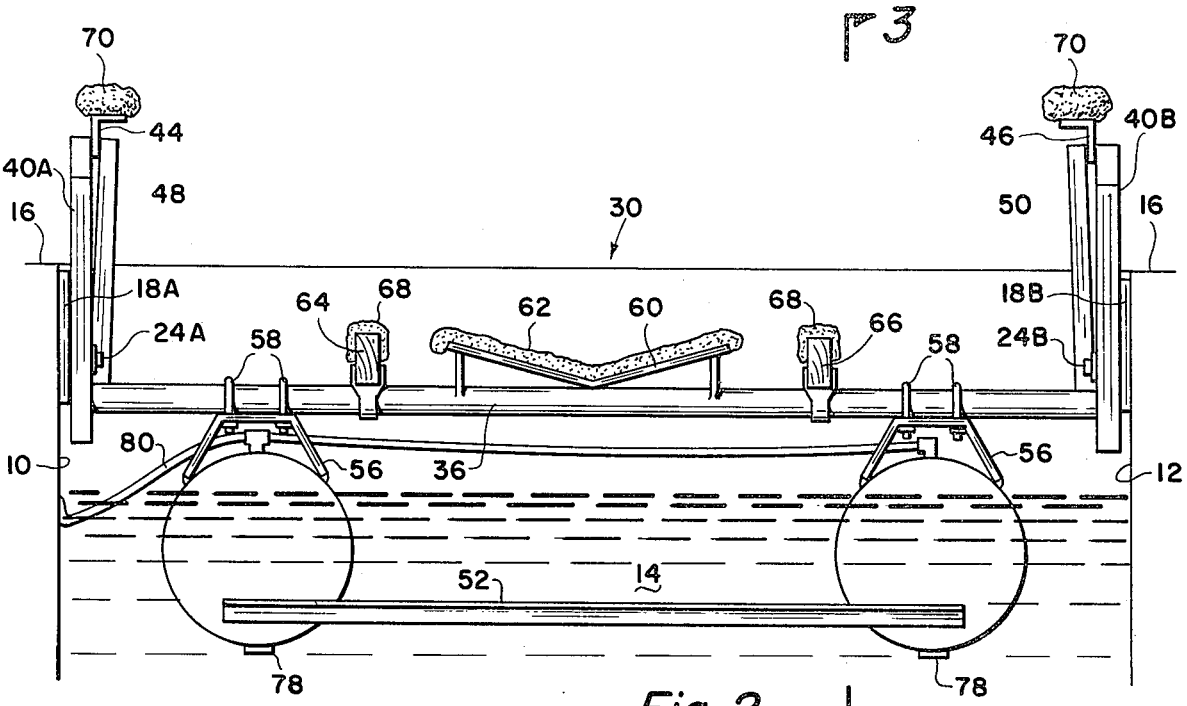
FIG. 2 is a front end view of the boat lift of FIG. 1.
Figure 3:
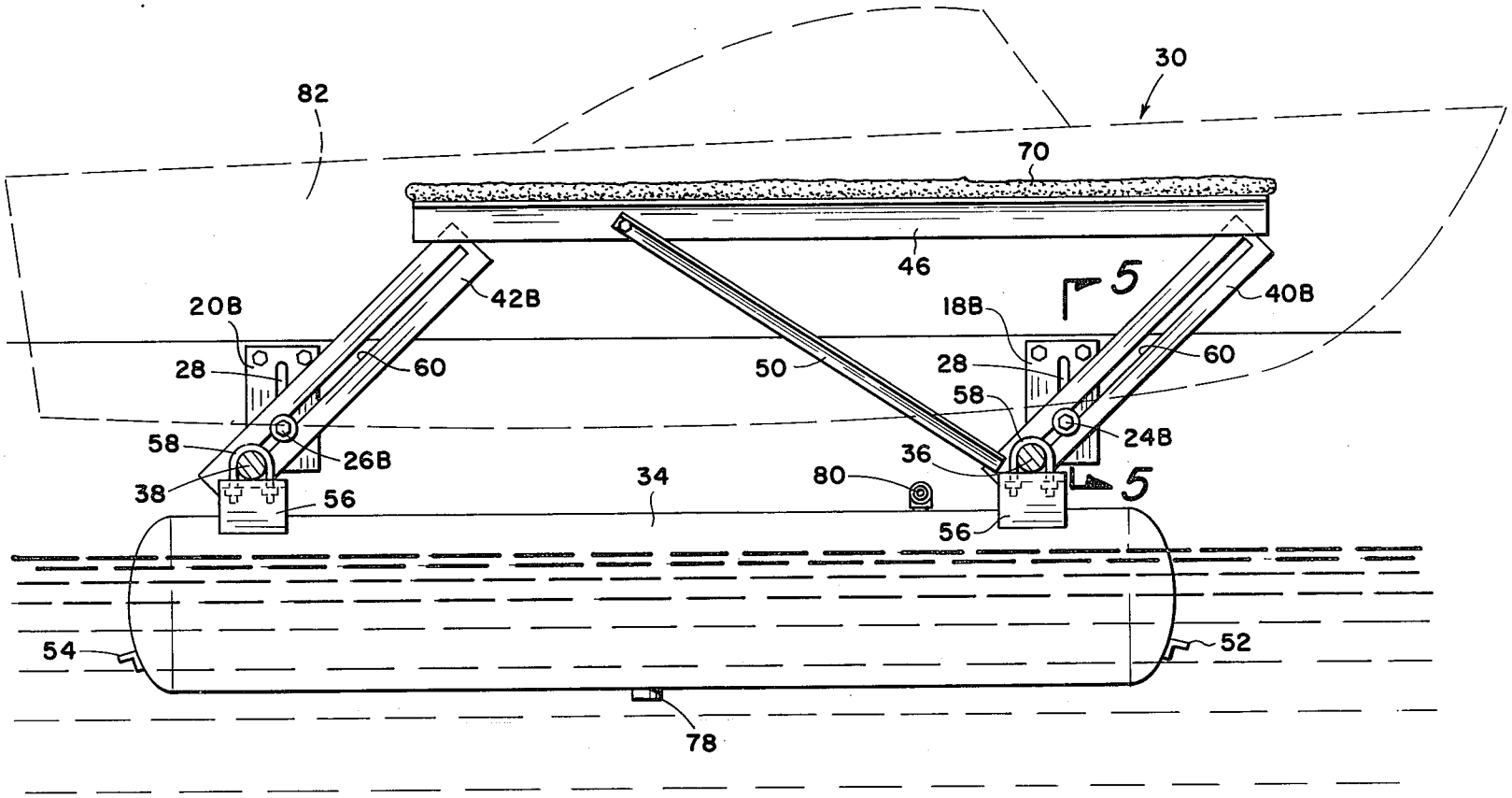
FIG. 3 is a side view of the boat lift with the pontoon and lift shown in floating position and with a boat in dotted outline thereon as it would appear supported on the lift, the boat shown supported above the water as in the storage mode.

Referring to the drawings and first to FIGS. 1, 2 and 3, a boat lift encompassing the invention is illustrated. The boat lift is shown as positioned in a well in a boat dock, the well having sidewalls 10 and 12. The sidewalls of the boat dock are at least partially above the surface of water 14 and the spacing between the walls 10 and 12 is such as to permit a boat to be moved in and out of the boat well with ease. In most docks adapted for storage of pleasure boats on the water, the boat wells have walkways 16 to either side of the boat well to permit entry into and exit from a boat placed in the boat well.

Affixed to the boat well sidewalls 10 and 12 are two pairs of attachment plates, the forward pair being designated as 18A and 18B and the rearward pair as 20A and 20B. The attachment plates are vertical and are affixed to the sidewalls, such as by means of bolts 22. Each attachment plate has a trunnion extending horizontally therefrom forming two pairs of trunnions, each pair being in axial alignment. The axii of the trunnions being spaced apart and parallel each other. The forward trunnions are indicated by the numerals 24A and 24B and rearward trunnion by 26A and 26B. In preferred arrangement each of the attachment plates 18A, 18B, 20A and 20B has a vertical slot 28 therein (see FIGS. 3 and 5) and the trunnion members 24A, 24B, 26A, 26B are arranged so that the elevational position of each trunnion may be selected by moving it up and down in the slot 28. The reason the slot 28 is used is to permit varying elevations of the trunnion members so that the boat lift may be more readily adapted to fit different boat dock structures. It can be seen that instead of slot 28 a plurality of holes of varying elevations may be provided in the attachment plate by which the elevation of the trunnions may be varied.

To raise and lower a boat a frame generally indicated by the numeral 30 is utilized. In the illustrated arrangement frame 30 is formed of a first elongated cylindrical pontoon 32, a second elongated cylindrical pontoon 34 (the pontoons having other functions which will be described subsequently), a forward structural cross member 36 which is secured to the upper surface of each of the pontoons 32 and 34, a rearward structural cross member 38, which likewise is secured to the pontoons 32 and 34, a forward pair of paralleled guide members 40A and 40B, a first horizontal structural member 44, a second horizontal structural member 46, a first stabilizer member 48, a second stabilizer member 50, a forward pontoon brace 52 and a rearward pontoon brace 54.

The forward and rearward structural cross members 36 and 38 are attached to pontoons 32 and 34 by means of brackets 56, which are welded to the pontoons, and U-bolts 58. Obviously, other means may be employed for attaching the structural cross members 36 and 38 to the pontoons 32 and 34.

The forward guide members 40A and 40B are each welded at the lower end to forward structural cross member 36 and in like manner the rearward guide members 42A and 42B are each welded at their lower ends to the rearward structural cross member 38. The upper end of guide members 40A and 42A are welded to the first horizontal structure member 44 and in like manner, the upper end of guide members 40B and 42B are welded to the second horizontal structure member 46. First stabilizer member 48 is welded at its lower end to the lower end of forward guide member 40A and at the upper end to the first horizontal structure member 44 and in like manner the lower end of second stabilizer member 50 is welded to the lower end of forward guide member 40B and the upper end is welded to the second horizontal structure member 46. Instead of welding the members may be attached by means of bolts.

Figure 5:
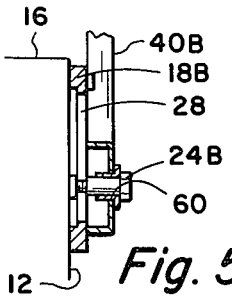
FIG. 5 is a cross-sectional view taken along the line 5—5 of FIG. 3 showing the details of the support plates and trunnions members.
Figure 4:
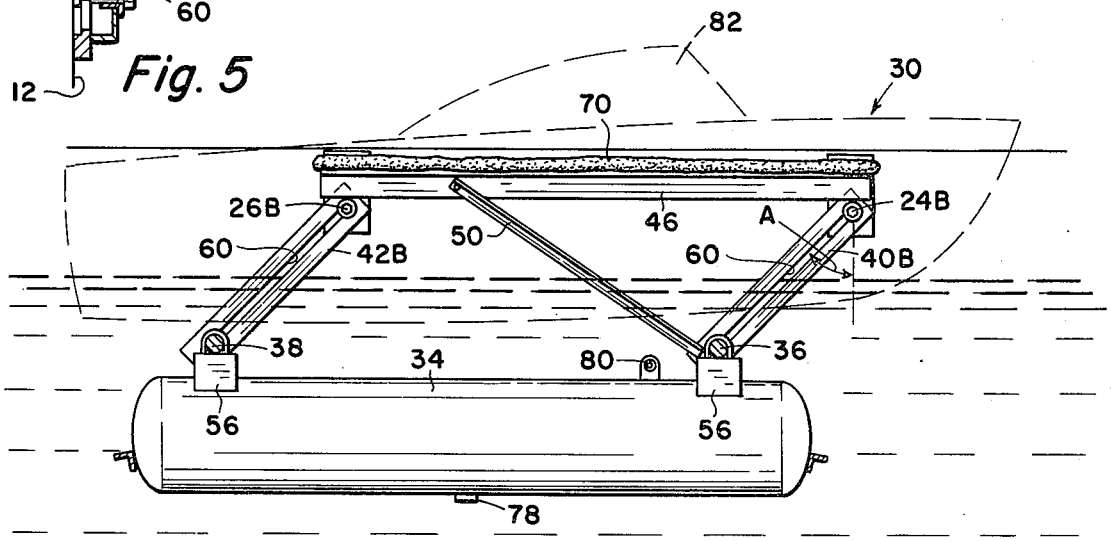
FIG. 4 is a reduced dimensioned side view as shown in FIG. 3 but showing the pontoon and frame displaced downwardly into the water and showing a boat shown in dotted outline floating on the water surface above the frame as in the mode wherein the boat is launched.

Each of the guide members 40A, 40B, 42A, 42B has an elongated slot 60 therein (see FIG. 3). Each slot 60 receives a trunnions member. Each of the trunion members 24A, 24B, 26A, 26B are arranged, as illustrated in FIG. 5, so that after the boat lift is installed the trunnions members cannot be withdrawn from the slot 60 in the guide member in which the trunnions member is positioned. The trunnions and slots in the guide members are arranged so that the guide members may be freely longitudinally displaced relative to the trunnions. The slot in each guide member 40A, 40B, 42A and 42B is displaced at a uniform angle relative to vertical as shown in FIG. 4, the angle of displacement being indicated by the letter A. Angle A is preferably about 45°, however, the angle may depart from this specific angle and may vary from 15° to 75° with an angle between 30° and 60° being highly preferred and an angle of 45° being ideal.

Supported on the forward structure cross member 36 is a V-shaped member 60 having a cushion material 62 thereon. The function of the V-shaped member 60 is to receive the forward end of the bottom of a boat supported on the boat lift. Positioned on the forward structural cross member 36 and rearward structural cross member 38 are paralleled runners 64 and 66, each having cushion material 68 thereon. The function of the runners 64 and 66 is to receive the forward portion of the bottom of a boat positioned on the boat lift. The arrangement of the V-shaped member 60 and runners 64 and 66 may vary considerably and any arrangement which will engage the bottom of a boat to be lifted in a manner so as not to damage the boat would be useful in practicing the invention.

Elongated protective members 70 may be secured to the first and second horizontal structural members 44 and 46 as shown in FIGS. 2, 3 and 4, to guard against damage to a boat which drifts against the side of the boat lift when it is lowered into the water. When the boat is lifted out of the water, the side of the boat will not normally engage the protective member 70. The protective members 70 are not shown in FIG. 1 so as not to obscure details of other structural members.

In order to raise a boat positioned on the boat lift it is necessary to cause the pontoons 32 and 34 to float. To do this water in the pontoons must be displaced. This can be achieved either by pumping the water out or forcing the water out with air. The latter arrangement is preferred because air can be moved faster than water and because it does not require a pump to be in contact with the water. As shown in FIG. 1, a small air compressor 72 driven by electric motor 74 may be used to force air into the pontoons 32 and 34. The pontoons have an opening 78 in the bottom so that as air is forced into the pontoons water is forced out through openings 78. A hose 80 connects the air compressor with each of the pontoons.

In addition to the air compressor 72 and hose 80 normal installation will include a check valve (not shown) so that after water is forced out of the pontoons by air pressure and the motor 74 disengaged, the air is prevented from escaping and thereby maintains the boat lift in the floating position. In addition, a hand valve (not shown) will be employed to release the air when it is desired to sink the pontoons to launch a boat therefrom. The check valve and hand valve are not illustrated since their use is well known in the art of boat lifts.

OPERATION

FIG. 4 is a side cross-sectional view showing the boat lift with the pontoons filled with water sufficient that the pontoons and the frame are sunk into the water. With the boat lift in the position as shown in FIG. 4, a boat may be floated into position over the boat lift, the boat being indicated by numeral 82. With the boat properly positioned over the boat lift motor 74 is energized, activating air compressor 72, forcing air by way of hose 80 into pontoons 32 and 34. Air pressure within the pontoons displaces water which flows out through openings 78. As the pontoons gain buoyancy they move the frame 30 of the boat lift upwardly until the V-shaped member 62 and runners 64 and 66 engage the bottom of the boat. Further compression of air and further water displacement increases the buoyancy to overcome the weight of the boat and the frame with the boat thereon is floated upwardly.

As the frame floats upwardly the slotted guide members 40A, 40B, 42A and 42B move relative to the trunnion members 24A, 24B, 26A and 26B. The angle of displacement of the guide members will cause the frame to move forwardly as it moves upwardly. It is to be noted, however, that at all times the frame and the boat thereon remains level. The front of the frame and the boat thereon cannot be displaced vertically relative to the rear of the frame because of the interaction of the trunnion members and guide members. Likewise, the frame cannot tilt about its longitudinal axis because of the relationship of the guide members and the trunnions. It can be seen that if the slots 60 in guide members 40A, 40B, 42A and 42B were vertical, that is where the angle A shown in FIG. 4 was zero, then the front of the frame would be free to move upwardly relative to the back of the frame and vice versa. In like manner, the frame could pivot to one side or the other. Therefore, the angle A must be displaced from zero and must be at least 15°, otherwise the frame will tilt or pivot if unequal load distribution is placed on it. It can also be seen that angle A cannot be 90°, otherwise the frame could not move up and down although it would be prohibited from tilting in any direction. For this reason the angle A of the guide members is preferably near 45° which produces sufficient resistance to pivoting of the frame when subjected to unequal loading, while at the same time allows the frame to rise and fall without undue forward and backward displacement.

The invention has been described wherein the frame is formed using the pontoons 32 and 34 as part of the structure. This arrangement has advantages when the pontoons are formed of metal since it reduces the number of components necessary to make up the frame. It can be seen that all the frame could be made of structure members with the pontoons merely attached to the lower surface of the frame. This arrangement is desirable when the pontoons are made of plastic or fiberglass.

When it is desired to launch a boat all that is required is to release air pressure on the pontoon, allowing water to enter and as buoyancy is lost the frame and boat thereon are lowered gently into the water.

It can be seen that the invention as described provides an apparatus for lifting a boat out of the water which does not require any pivotal arrangement and which maintains a boat in a level conditioned at all times. The angle of the boat relative to the horizontal does not change from the time the frame engages the bottom surface of the boat until it is raised to its maximum height.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed:

1. For mounting in a boat well having opposed parallel vertical sides spaced above the surface of a body of water, the spacing between the sides of the boat well being dimensioned to receive a boat therein floating on the water, an apparatus to lift a boat within the boat well above the water surface, comprising:

a forward pair of trunnion members supported to said boat well side wells in horizontal axial alignment and a rearward pair of trunnion members supported to said boat well sidewalls in horizontal axial alignment, the axii of the forward and rearward pairs of trunnion members being parallel and spaced apart from each other;

a frame adapted to be lowered to receive a boat floating in the water thereon and to be raised with a boat thereon to lift the boat thereon above the water surface, the frame having a forward pair of guide members and a rearward pair of guide members, the four guide members each being in vertical planes and each having an elongated slot therein which slidably receives a said trunnion member, the slots in each of said four guide members being of the same angle relative to vertical of between 15° and 75°, the frame having means thereon to engage the bottom of a boat when the frame is lowered to a lowermost position with a portion thereon below the water surface;

a pontoon secured to the lower portion of said frame;

means for admitting water into the pontoon to sink the pontoon and a portion of said frame below the water surface; and means to evacuate water from said pontoon to float the frame upwardly to support a boat thereon above the water.

2. A boat lift apparatus according to claim 1 wherein said pontoon is in the form of two elongated spaced apart paralleled tanks positioned perpendicular the planes of said pairs of trunnions.

3. A boat lift according to claim 2 wherein said tanks are of metal and form a part of said frame.

4. A boat lift according to claim 1 including two pairs of vertical attachment plates having means to be affixed to the boat well sidewalls, a said trunnion member being secured to each said attachment plate.

5. A boat lift according to claim 4 wherein each said attachment plate includes means of varying the elevation at which said trunnion member is attached to it.

6. A boat lift according to claim 1 in which the slot in each of said guide members is at an angle of about 45° relative to vertical.

7. A boat lift according to claim 1 in which said means to evacuate water from said pontoon includes an air compressor connected to said pontoon, the pontoon having an opening adjacent the bottom thereof, the air compressor, when energized, serving to force air into the pontoon to force water out through said opening.

* * * * *